United States Patent [19]

Gessler

[11] Patent Number: 4,531,876

[45] Date of Patent: Jul. 30, 1985

[54] STORAGE SILO FOR DIFFICULTLY FLOWING BULK MATERIAL

[75] Inventor: Hans Gessler, Aalen, Fed. Rep. of Germany

[73] Assignee: Schwäbische Hüttenwerke GmbH, Aalen-Wasseralfingen, Fed. Rep. of Germany

[21] Appl. No.: 410,947

[22] Filed: Aug. 24, 1982

[30] Foreign Application Priority Data

Sep. 5, 1981 [DE] Fed. Rep. of Germany ..... 3135295

[51] Int. Cl.[3] ..... B65G 65/42

[52] U.S. Cl. ..... 414/325; 222/564; 414/326

[58] Field of Search ..... 414/288, 293, 299, 325, 414/326, 304; 222/564, 146 H; 193/12

[56] References Cited

U.S. PATENT DOCUMENTS

| | | | |
|---|---|---|---|
| 826,729 | 7/1906 | Marsh | 193/12 |
| 1,928,459 | 9/1933 | Pardee | 414/288 X |
| 3,260,382 | 7/1966 | Klover | 414/325 X |
| 3,710,959 | 1/1973 | Gessler | 222/459 X |
| 3,800,985 | 4/1974 | Grout et al. | 222/146 H |
| 3,985,244 | 10/1976 | Gessler et al. | 414/304 |
| 4,365,730 | 12/1982 | Ezban | 222/547 |

FOREIGN PATENT DOCUMENTS

| | | |
|---|---|---|
| 1951754 | 4/1971 | Fed. Rep. of Germany . |
| 2318560 | 11/1974 | Fed. Rep. of Germany . |

*Primary Examiner*—Joseph E. Valenza
*Assistant Examiner*—Stuart J. Millman
*Attorney, Agent, or Firm*—Horst M. Kasper

[57] ABSTRACT

A storage silo adapted to difficultly flowing bulk materials to be discharged at the bottom of the silo. A baffle is disposed in a cylindrical container. The baffle is attached to the cylindrical container wall and runs inclined along said wall to the silo bottom. Baffle sections extend along a helical path over a central angle of at least about 360 degrees and are substantially continuously connected. At least some baffle sections following in circumferential direction along the silo wall are staggered with respect to each other increasing with the distance from the bottom. The baffle is preferably provided as a helical band. The pitch angle of the baffle relative to the cylindrical wall can be from about 15 to 30 degrees. A heating element can be provided to allow for heating of at least part of the baffle.

18 Claims, 4 Drawing Figures

STORAGE SILO FOR DIFFICULTLY FLOWING BULK MATERIAL

BACKGROUND OF THE INVENTION

1. Field of the Invention

The present invention relates to a storage silo for difficultly flowing bulk material, which is to be discharged at the bottom end of the silo and which is provided with deceleration baffles.

2. Brief Description of the Background of the Invention Including Prior Art

The discharging of difficultly flowing bulk material from a tower silo or a storage silo is rendered difficult by the formation of bridges and/or domes inside of the column of bulk material present in the silo, which bridges and domes interfere with the gravitation induced flow of the bulk material. Then the bulk material cannot move or cannot move fast enough to be discharged from the silo, since insufficient amounts of material continue to slide to the lower silo end. The bulk material cannot be sufficiently gripped and taken by the mechanical devices in general disposed at the bottom end of a silo such as for example worms, scraping devices, agitators, stirrers, slideways and the like.

A silo of the kind initially set forth is known from the German Patent Laid Open No. 1,951,754. The frictional deceleration device of this silo comprises several wedges, which in a plan view on the silo form three groups disposed at a distance behind each other, which in each case take up a central angle of less than 120 degrees. The wedges are staggered within each group with increasing distance from the bottom, where at the same level of the silo in each case are provided three wedges, each of which belonging to another of the three groups. At this arrangement of the baffles special measures are necessary to avoid a clamping and/or bridging of the silo bulk material between the wedges neighboring in circumferential direction. The inclined side faces provided for this purpose at the wedges are in fact effective with many difficultly flowing materials, however, under difficult conditions they are not always in a position to prevent the formation of bridges. A further silo with a frictinal deceleration device is known from German Patent Application Laid Open De-OS No. 2,318,560, which comprises several conical baffles, which are disposed at a distance on top of each other at the silo wall and which are adjoining the silo walls with their upper edges. The decelerating surface of these baffles also runs inclined from the silo wall to the silo bottom. These baffles increase the frictional values between bulk material and silo wall, whereby a predetermined weight part of the bulk material column is accepted by the silo wall. The thereby reduced vertical loads effect in the respective planes of the bulk material column a reduction of the horizontal tensions, which exert an important influence on the stability of bridges and domes within bulk material columns.

The angle of inclination of the conical baffles has to be selected such that it does surpass the specific angle of repose of the bulk material in each case in order to prevent the motion of the bulk material upon discharge to come to an end. Then no such horizontal tension can arise within the column of bulk material, which would lead to the build-up of stable bridges and domes. Thus in the dimensioning of these baffles the kind of the bulk material to be stored or respectively its angle of repose have to be taken into consideratin. With many bulk materials the critical horizontal tensions can be disposed below a certain value, which tensions would lead above the certain critical value depending on the kind of the bulk material in the column to the formation of rigid and stable bridges and domes in these known silos. The stability and rigidity of the bulk mateial are then too low for the formation of supporting bridges and domes, and under these conditions bridges or domes collapse continuously. Silos comprising the described frictional deceleration devices have proven to be of value in the context of small, medium and large volume silos for numerous difficulty flowing bulk mateials, such as for example wood chips, dust, sludge, chemical and mineral materials, and root chips.

In case materials with a particularly high bulk density are to be stored in such silos, which materials in addition can be compressed to a large degree such as for example peelings and bark, in particular pine bark, then particular difficulties arise at the discharging of the materials stored. The unloading of a bulk material column comprising such fibrous materials cannot be metered such that a substantially constant relationship is achieved between the wall friction and the residual load of the column of bulk material. Depending on the structural state in each case of the bulk material there is also a constant change for the ratio between the decelerating effect and the residual load of the column. Thereby the decelerating friction frequently becomes too low such that the vertical load and the horizontal tensions caused therewith prevail. At a changed state of the structure the decelerating friction can be too large such that the motion of the column of bulk material stops at one or more places, since the residual load is insufficient to keep the gravitation induced flow going of the bulk material. In the two cases despite different causes the same effect occurs: the bulk material cannot be discharged any longer. The reason for this phenomenon is based on the described behavior of the bulk material, which can be compared to some extent with the behavior of rubber.

SUMMARY OF THE INVENTION

It is an object of the present invention to provide a storage silo such that the downward motion of the bulk material necessary for the discharge of the bulk material is always supported by way of baffles independent from the structure of the bulk material. It is a further object of the present invention to provide a baffle for a storage silo which is adapted to work under extreme conditions such as subfreezing ambient temperatures or as encountered with fibrous bulk materials.

These and other objects and advantages of the present invention will become evident from the description which follows.

BRIEF DESCRIPTION OF THE INVENTION

The present invention provides a storage silo adapted to difficultly flowing bulk material to be discharged at the bottom of the silo. A helical baffle is disposed in a cylindrical container, which baffle is attached to the cylindrical container wall and runs inclined along said wall to the silo bottom. The baffle sections extend along a helical path over a central angle of at least about 360 degrees and are substantially continuously connected.

At least some in circumferential direction of the silo wall following baffle sections can be staggered with respect to each other and increasingly so with respect to the distance from the bottom. The friction baffle can comprise a helical band. The pitch angle of the baffle relative to the cylindrical wall can be different at different levels of the silo. The pitch angle of the baffle relative to the geometrical wall in one region can be from about 15 degrees to about 30 degrees and preferably from about 20 degrees to about 25 degrees.

At least two sequential baffle sections can have a different distance determined parallel to the cylinder axis. The distance between sequential baffle sections can decrease from the top of the silo toward the bottom of the silo and the friction baffle can extend substantially over the full free length of the silo. A filling opening can be disposed at the top of the silo, a discharge provision can be disposed at the bottom of the silo, and the friction baffle can extend substantially over the full length of the silo from the filling opening to the discharge provision. The discharge provision can comprise a discharge worm, a rotary scraping device or other transport inducing device.

The friction baffle can be disposed at different ascending gradient slopes over its axial extension. The angle of the ascending gradient slope can decrease in the direction to the bottom of the silo. Preferably, the baffle has a constant width over its length. A heating device can be provided to heat the friction baffle at least over part of its length. There can further be provided a second baffle such as a wedge-shaped baffle or a baffle having a surface shaped like a section of a cone.

There is further provided a method for giving flow to difficultly flowing bulk material in a storage silo. Baffle sections can be disposed in a cylindrical silo shell and attached to the wall of the shell, which baffle sections form substantially a continuous sequence like a helix. Said baffle sections can have a center angle of at least about 360 degrees with a pitch directed from the point of attachment at the cylindrical wall toward the bottom of the silo. The baffle sections can be sequentially disposed in the circumferential direction of the cylindrical wall and can be staggered and the distance between the sections can increase with increasing distance from the bottom of the silo.

According to the provision of the invention the decelerating surface inclined toward the bottom of the silo is also inclined with respect to the wall surface of the silo. The bulk material is in fact decelerated on this surface, however does not rest there, since it is capable of sliding continuously to the bottom of the silo. During this sliding the bulk material is not restrained in any horizontal plane of the silo at neighboring decelerating surface sections simultaneously. The friction thus on the one hand cannot become too large, but also on the other hand not too small, since the bulk material is supported along a substantially closed path. Based on this one sided support the angle of inclination, under which the decelerating surface meets the cylinder wall, is not of large importance such that even considerable deviations will not interfere with the discharging function of the silo. Finally, the construction in accordance with the invention in addition substantially increases the effective decelerating surface.

The decelerating surface does not any longer enclose a wedge angle with the silo wall based on the helical path, but in addition there is provided an ascending gradient angle with respect to the horizontal silo planes. Therefore, the wedge and/or the ascending gradient angle can be adjusted for adaptation to the properties of the bulk material in each case, such that in case of bulk materials with higher bulk density and larger tendencies to bridge formation such as tree bark, in particular pine bark, or similar fibrous materials there is made possible a constant, sufficient relief of the bulk material column. The ratio between the wall friction and the residual load of the column of the bulk material can be kept nearly constant in all horizontal planes through the silo.

The novel features which are considered characteristic for the invention are set forth in particular in the appended claims, The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

In the accompanying drawings in which are shown four of the various possible embodiments of the present invention.

DESCRIPTION OF INVENTION AND PREFERRED EMBODIMENTS

Figure 1:
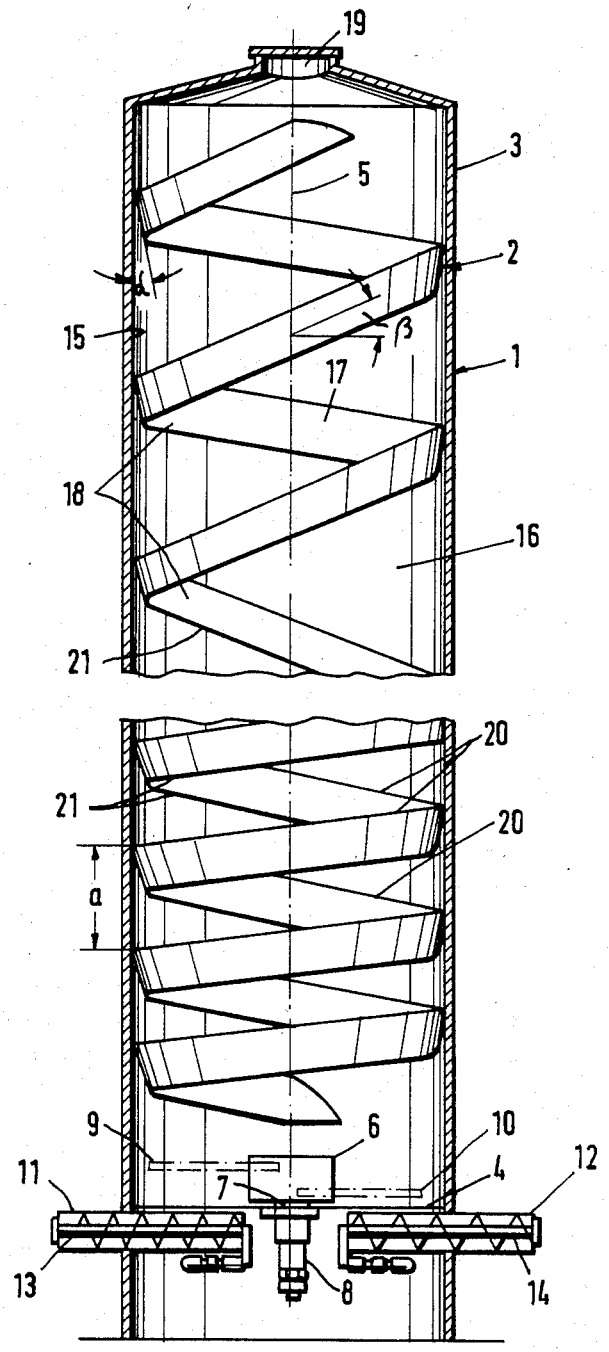
FIG. 1 is a schematic view in section of a storage silo with a baffle according to the present invention.

In accordance with the present invention there is provided a silo for in particular difficultly flowing bulk materials to be discharged at the bottom end having baffles serving as frictional deceleration devices. The decelerating surface of the baffles is inclined at an angle relatively from the silo wall to the bottom of the silo and the surface of the device is disposed in different levels of the silo interior space. At least some of the decelerating surface sections following as a sequence along the circumferential direction of the silo wall are staggered with respect to each other with increasing distance from the bottom of the silo. The decelerating surface sections 18 run along a helical path over a center angle of at least 360 degrees and follow in sequence within this path substantially without gaps.

The frictional decelerating device 2 can comprise at least one band-shaped helix. The pitch angle $\alpha$ of the decelerating surface 17 relative to the wall 15 of the silo can be different at different levels of the silo 1. The pitch angle $\alpha$ can be between 15 and 30 degrees and is preferably between 20 to 25 degrees. At least two, but preferably several sequentially following decelerating surface sections 18 can have a different distance "a" from each other. Preferably, the distance "a" of sequentially following decelerating surface sections 18 decreases continuously toward the silo bottom 4.

The frictional decelerating device 2 can extend substantially over the full free height of the silo 1 and preferably from the filling opening 19 to a discharge provision 6 such as for example a discharge worm, a rotary hoe, a milling cutter or the like. The frictional decelerating device 2 can have different ascending gradient angles over its axial extension. Preferably, the ascending gradient angle $\beta$ decreases continuously in the direction to the bottom of the silo 4. The frictional decelerating device 2 can have a constant width over its length and at least part of the length of the decelerating device 2 can be heatable. In addition to the friction device 2, at least one second friction device of preferably wedge and/or conical and/or conical ring shape can be provided.

FIG. 1 shows a chip storage silo 1 with a frictional decelerating device 2. This silo 1 is provided with a cylindrical wall 3 and at the bottom with a discharge provision, which comprises a scraping rotor, which can rotate around the vertical silo axis 5. The rotor 6 passes with its shaft 7 through the floor 4 of the silo, above which are disposed two scraping arms 9 and 10. Below the silo floor 4 the shaft 7 supports a variable speed transmission motor 8. In addition, conveying worms radially aligned with the rotor and with respect to each other are prqvided, which worms are supported in the conveying though 11 or respectively 12. The decelerating device 2 can also be disposed in a silo with conical discharge, which is not provided with a removal provision or which cooperates with a take off system independent from the silo, which can be a rotating cutter or a rotating worm.

The decelerating device 2 formed as a helix is attached to the silo wall 15. The side of the decelerating device disposed toward the free interior of the silo furnishes a decelerating surface 17 for the respective bulk material in each case. The decelerating surface 17 is composed from decelerating surface sections 18 which form the individual helix or respectively worm passages and which run inclined toward the bottom in the longitudinal direction of the silo 1 along the silo wall 15 over a center angle of 360 degrees in each case. The decelerating device 2 extends nearly over the total free silo height such that it has in each case only a small distance from the rotor 6 and the filling opening 19 of the silo 1.

The decelerating device 2 is attached to the silo wall edge 20 for example by welding, while the lower edge 21 of the decelerating device 2 protrudes into the free space of the interior space 16 of the silo. Therefore, the decelerating surface sections 18 enclose with the silo wall a pitch angle or a wedge angle $\alpha$ in each case, which is about 15 degrees in the example illustrated. Depending on the properties of the bulk material in each case this wedge angle can be different along the height of the silo and in particular it can increase in the direction toward the silo floor such that the helix 2 protrudes further into the interior of the silo as compared with the upper region. Correspondingly, in addition, decelerating surface section can be adjusted individually with a lower angle to the silo wall. It is also possible to select different widths for the helix, for example such that despite different wedge angles $\alpha$ the amount of the protrusion into the interior space remains the same.

The helix 2 encloses with the horizontal silo planes an ascending gradient angle $\beta$, which continuously decreses in the direction to the silo floor according to the embodiment of FIG. 1. Therefore, the distance "a" of neighboring decelerating surface 18 is different in each case and it decreases in the direction to the silo floor 4, such that with increasing weight of the bulk material column there is available a larger decelerating surface. Thus the decelerating effect is adapted to the vertical load, which increases from the upper edge of the bulk material in the direction toward the silo floor 4 corresponding to an about exponential function.

Figure 4:
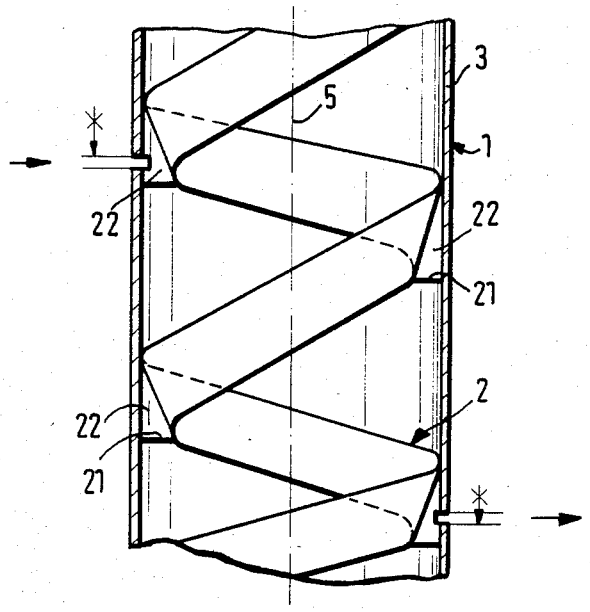
FIG. 4 is a schematic view in part in section of a storage silo comprising a heating device.

In order to prevent that the bulk material freezes in the winter time to the silo wall and to the helix 2, the helix can be heated along its full length or, for example, in the case of very large volume silos only in its lower region. As shown in FIG. 4, the inner edge of the helix 2 is connected to the silo wall by a plate 21 constituting the bottom of a channel or passage 22 for circulating hot water or steam. By heating the helix, frozen particles of the material cannot adhere thereon.

Figure 2:
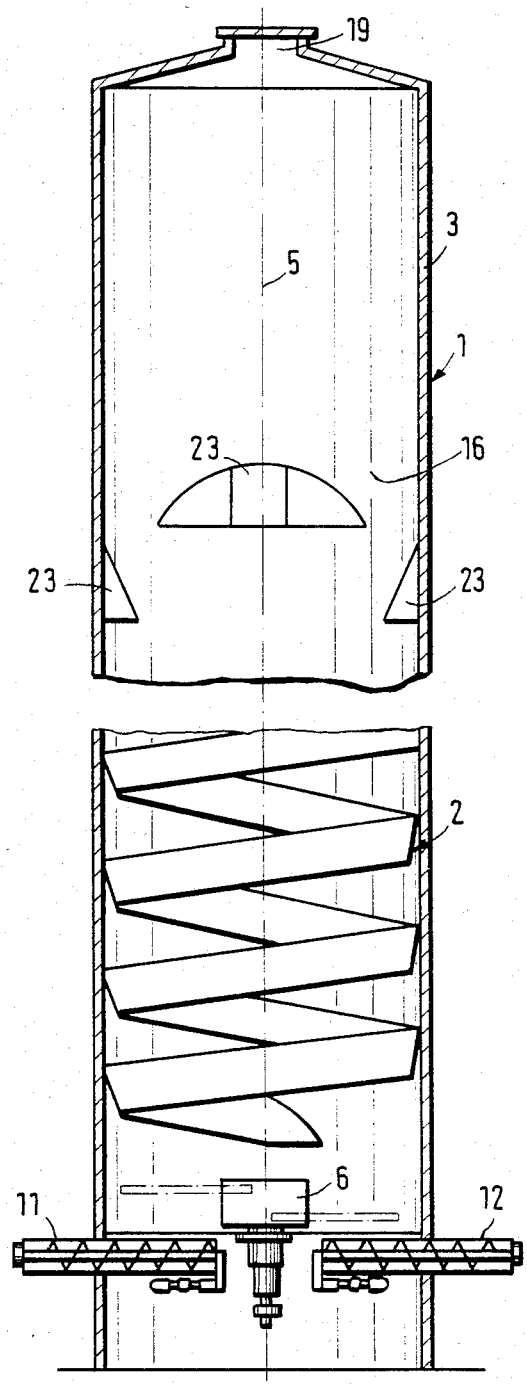
FIG. 2 is a schematic view in section of a storage silo with a second baffle which is a wedge baffle.
Figure 3:
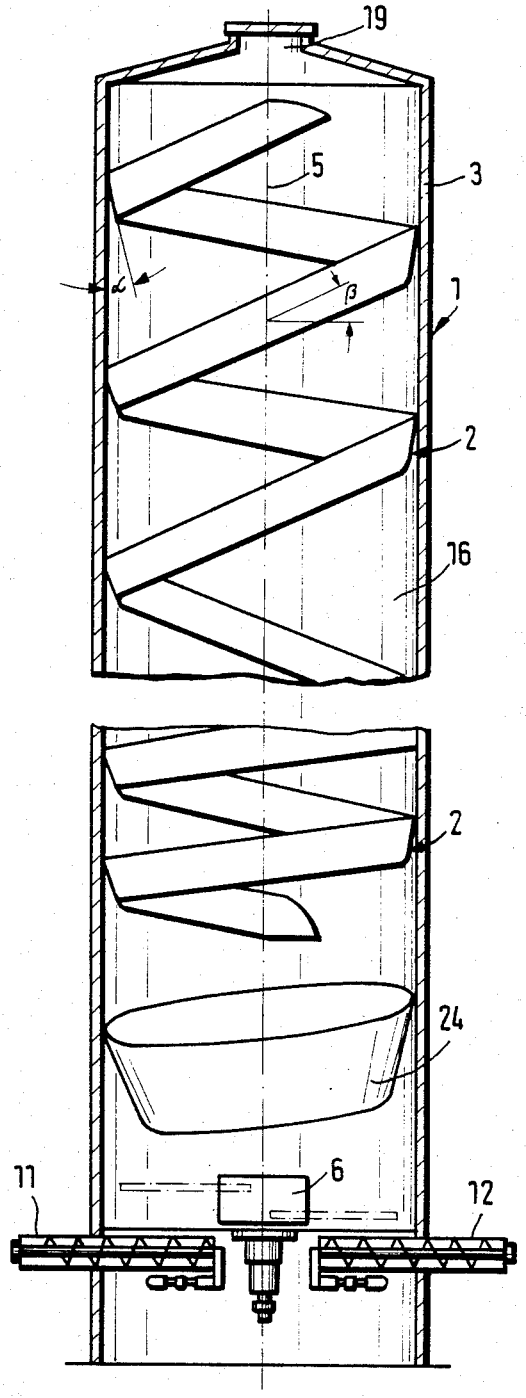
FIG. 3 is a schematic view in section of a storage silo with a second baffle which is conical shaped.

The silo wall can also be provided with a thermal insulation not shown in the drawing, which insulation prevents freezing in cases where the heating elements are disposed only at the bottom end of the helix. In case a free space is provided above or below the helical frictional decelerating device, then there can be provided additionally for example wedge or conical shaped frictional decelerating devices 23 and 24 respectively as shown in FIG. 2 and 3 respectively, the shapes of which are disclosed in detail for example in the German Patent Application Laid Open DE-OS No. 2,318,560 and in German Patent Laid Open DE-OS No. 1,951,754. Also in the region between individual decelerating sufrace sections or respectively individual helixes disposed at a distance from each other there can be attached additionally such frictional decelerating devices at the wall of the silo.

It will be understood that each of the elements described above, or two or more together, may also find a useful application in the other types of industrial and/or agricultural storage silo system configurations and discharging procedures differing from the types described above.

While the invention has been illustrated and described in the context of a storage silo or bin for difficultly flowing bulk materials, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various application without omitting features that, from the standpoint of prior art, fairly constitute essential characteristics of the generic or specific aspects of this invention.

What is claimed as new and desired to be protected by Letters Patent is set forth in the appended claims.

I claim:

1. Storage silo adapted to difficultly flowing bulk material to be discharged at the bottom of the silo comprising a substantially cylindrical container having an unobstructed opening near the top; and a deceleration baffle disposed in the container, which baffle is attached to the container wall and runs inclined along said wall like a helix section relative to the center axis of the silo toward the silo bottom and where the baffle sections extend along a helical path over a central angle of at least about 360 degrees and are substantially continuously connected for steadying the flow of the bulk material as the level of the bulk material contacts the baffle such that the distribution and flow of the material in the silo is controlled during outflow through a discharge opening and the bulk material is directed to the center of the silo by the baffle surface wherein at least some baffle sections which are vertically aligned along the silo wall are increasingly spaced with respect to teach other as the distance increases from the bottom of said container.

2. Storage silo adapted to difficulty-flowing bulk material according to claim 1 wherein the baffle comprises at least one helical band.

3. Storage silo adapted to difficulty flowing bulk material according to claim 1 wherein the pitch angle of the baffle relative to the cylindrical wall is different at different levels of the silo.

4. Storage silo adapted to difficulty flowing bulk material according to claim 1 wherein the pitch angle of the baffle relative to the cylindrical wall in one region is from about 15 to about 30 degrees.

5. Storage silo adapted to difficulty flowing bulk material according to claim 4 wherein the pitch angle of the baffle relative to the cylindrical wall in one region is from about 20 degrees to about 25 degrees.

6. Storage silo adapted to difficulty flowing bulk material according to claim 1 wherein at least two sequential baffle sections have a different distance determined parallel to the cylinder axis.

7. Storage silo adapted to difficultly flowing bulk material according to claim 6 wherein the distance between sequential baffle sections decreases from the top of the silo toward the bottom of the silo.

8. Storage silo adapted to difficultly flowing bulk material according to claim 7 wherein the baffle extends substantially over the full free length of the silo.

9. Storage silo adapted to difficultly flowing bulk material according to claim 8 further comprising a filling opening disposed at the top of the silo; and a discharge provision disposed at the bottom of the silo, where the baffle extends substantially over the full length of the silo from the filling opening to the discharge provision.

10. The storage silo adapted to difficulty flowing bulk material according to claim 9 wherein the discharge provision comprises a discharging worm.

11. The storage silo adapted to difficultly flowing bulk material according to claim 9 wherein the discharge provision comprises a rotary scraping device.

12. The storage silo adapted to difficultly flowing bulk material according to claim 1 wherein the baffle is disposed at different ascending gradient slopes over its axial extension.

13. The storage silo adapted to difficultly flowing bulk material according to claim 12 wherein the angle of the ascending gradient slope decreases in the direction to the bottom of the silo.

14. The storage silo adapted to difficultly flowing bulk material according to claim 1 wherein the baffle has a constant width over its length.

15. The storage silo adapted to difficultly flowing bulk material according to claim 1 further comprising a heating device adapted to heat the friction baffle at least over part of its length.

16. The storage silo adapted to difficultly flowing bulk material according to claim 1 further comprising at least one second friction baffle.

17. The storage silo adapted to difficulty flowing bulk material according to claim 16 wherein the second baffle is a wedge baffle.

18. The storage silo adapted to difficultly flowing bulk material according to claim 16 wherein the second baffle comprises a surface shaped like a part of a cone.

* * * * *